United States Patent [19]

Tucek

[11] 4,005,894

[45] Feb. 1, 1977

[54] LOG GRAPPLING APPARATUS

[75] Inventor: Frank J. Tucek, Wausau, Wis.

[73] Assignee: J. I. Case Company, Racine, Wis.

[22] Filed: Oct. 16, 1975

[21] Appl. No.: 623,009

[52] U.S. Cl. ..... 294/88; 214/147 AS; 294/106

[51] Int. Cl.[2] ..... B66C 3/16

[58] Field of Search ..... 294/88, 104, 106, 107, 294/118; 144/3 D, 309 AC; 214/147 G, 147 AS

[56] References Cited

UNITED STATES PATENTS

| | | | |
|---|---|---|---|
| 2,604,220 | 7/1952 | Frischmann | 294/88 X |
| 3,048,288 | 8/1962 | Dwyer | 214/147 G |
| 3,310,335 | 3/1967 | Shuey | 294/106 X |
| 3,371,952 | 3/1968 | Hunger | 294/88 |
| 3,631,995 | 1/1972 | Jones et al. | 214/147 AS |
| 3,905,407 | 9/1975 | Guy et al. | 144/3 D |

*Primary Examiner*—Johnny D. Cherry
*Attorney, Agent, or Firm*—Dressler, Goldsmith, Clement, Gordon & Shore, Ltd.

[57] ABSTRACT

A grappling apparatus for gripping full length trees is disclosed herein. The grappling apparatus includes upper and lower frames that are rotated relative to each other and the lower head has transversely spaced fixed grapple heels located on opposite sides of the pivot axis between the frames. The lower frame has a pair of grapple arms pivoted thereon and the arms are interconnected by a link so that a single fluid ram can be used to pivot the arms between open and closed positions.

1 Claim, 4 Drawing Figures

LOG GRAPPLING APPARATUS

BACKGROUND OF THE INVENTION

The present invention relates generally to grapple equipment for manipulating tree length logs and more particularly to a grapple attachment for the end of a boom on a vehicle.

Log grappling devices are well known in the lumber and logging industry. These devices are used for removing logs from the forest area where they have been cut, moving them from one place to another, stacking, and loading and unloading them from trucks and railroad cars. One type of grappling device that has been in existence for numerous years consists of a grapple assembly pivoted on the outer end of a boom with a heel fixed to the grapple assembly and a pair of co-operable jaws pivoted on the assembly to grip the log. This type of device is shown in Larson U.S. Pat. No. 3,165,215 and Tanguay U.S. Pat. No. 3,709,390.

One of the problems encountered with this type of grappling device is the fact that the boom supporting the grapple assembly must be in general longitudinal alignment with the log to be picked up so that the log can be grasped by the grapple arms and stabilized by the grapple heel. Usually, when operating in a forest, the logs are of full length, being the height of the tree, which is substantially greater than the overall length of the grapple assembly and even the boom assembly supporting the grapple assembly. Thus, it is customary when utilizing grapple assemblies of the above type, to grasp the tree length log adjacent the base end, which is substantially greater than the opposite end so that the smaller end is cantilevered beyond the end of the grapple assembly. It should be noted that in devices of the above type, the heel is located inwardly of the position of the grapple jaws with respect to the boom upon which it is supported.

One of the problems encountered in utilizing such devices, particularly when the tree length logs are to be stacked on trucks or railroad cars, is the fact that the logs cannot be positioned on the trucks or railroad cars to fully utilize the space on the vehicle in a most efficient manner. As indicated above, tree length logs generally are substantially greater in diameter adjacent the butt or base end than they are adjacent the opposite end. With grapple assemblies of the above type, it is mandatory that the butt or base end of the tree be grasped which means that all of the trees must be inserted on the vehicle with the butt ends in abutting relation to each other. This means that a substantial area, particularly adjacent the tip ends of the tree is wasted in the transportation of logs from one site to another.

In order to alleviate this problem, it has recently been proposed to support the grapple assembly for universal pivotal rotation about a generally vertical pivot axis on the outer end of the boom. This type of device is disclosed in Jones et al. U.S. Pat. No. 3,631,995 and consists of a lower grapple head that is rotatably supported on an upper grapple head pivoted on the outer end of a boom. The lower grapple head has two pivotally supported grapple heels which engage the tree at selected locations as well as a pair of grapple arms for grasping the tree. While this type of unit has found some degree of commerical success, there are inherent shortcomings in a unit of this type, particularly the overall cost thereof.

The unit of the type disclosed in the above-mentioned Jones et al. patent requires four separate cylinders on the lower head of the grapple assembly, which of necessity requires very complicated hydraulic circuitry between the vehicle which supports the boom and the grapple assembly supported on the outer end of the boom.

SUMMARY OF THE INVENTION

According to the present invention, applicant has determined that the overall efficiency of a grapple assembly can be substantially increased without sacrificing any of the versatility of the unit. It has been determined that by proper arrangement of the various parts on a rotatable lower frame of a grapple assembly, only a single fluid ram is necessary for grasping and manipulating trees with a grab arm assembly supported on the outer end of a boom.

More specifically, the present invention comtemplates a grab arm assembly or heel boom log grappling apparatus that consists of upper and lower frames that are rotated about a fixed axis with respect to each other through a drive means with the lower frame supporting apparatus for grasping a tree. The apparatus for grasping a tree consists of a pair of fixed grapple heels that are spaced from each other and located on opposite sides of the rotational axis between the two frames with a pair of grapple arms located intermediate the two grapple heels. The grapple arms are pivoted about fixed pivot axes on the lower frame through a power means that is capable of grasping a tree and at the same time forcing the tree into engagement with the two fixed heels.

According to one aspect of the present invention, the two grapple arms are pivoted by a single fluid ram which is connected to one of the arms while one of the arms is interconnected with the second arm through a synchronizing rigid link so that both arms are simultaneously pivoted on the lower frame through extension and retraction of the single fluid ram.

DETAILED DESCRIPTION

Figure 1:
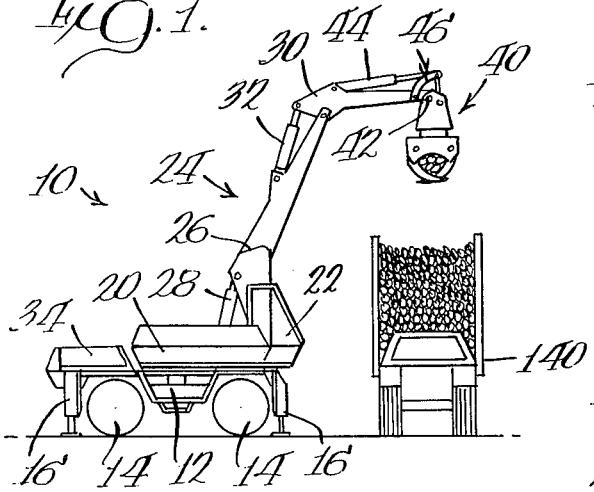
FIG. 1 shows a vehicle having the grapple assembly of the present invention incorporated therein.

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the invention to the embodiment illustrated.

FIG. 1 of the drawings generally discloses a vehicle 10 which incorporates mechanism constructed in accordance with the teachings of the present invention. Vehicle 10 consists of a chassis frame 12 supported on a plurality of wheels 14 with suitable outriggers 16 that can be extended to raise chassic frame off the ground. Chassis frame 12 supports a turntable 20 for rotation about a generally vertical axis and turntable 20 has an operator's compartment or cab 22 located thereon. Turntable 20 also supports a boom generally indicated at 24 and consisting of a first boom section 26 supported for pivotal movement about a horizontal pivot axis on turntable 20 through a fluid ram 28. The second boom section 30 is pivotally supported on the outer end of the first boom section 26 and is pivoted thereon through a fluid ram 32. Frame 12 has a power plant 34 for supplying the necessary power to the various components for the vehicle.

Figure 2:
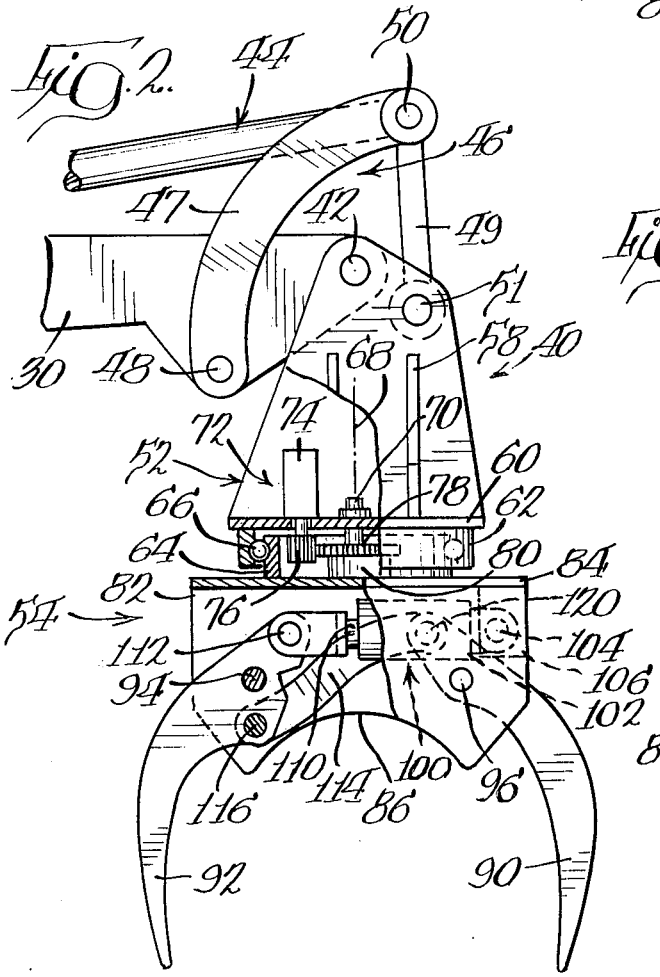
FIG. 2 is an enlarged fragmentary side elevation view of the grapple assembly supported on the outer end of the boom shown in FIG. 1.

The outer end of the second boom section 30 supports a grapple assembly 40 about a horizontal pivot generally indicated at 42 and the movement thereof is controlled by a fluid ram 44 and a linkage 46. As illustrated in FIG. 2, linkage 46 consists of a first link 47 having one end pivoted at 48 on boom section 30, while the opposite end is pivotally interconnected with a second link 49 and the piston rod of fluid ram 44 through a pivot pin 50. The opposite end of link 49 is connected to grab arm assembly through a further pivot pin 51.

Figure 3:
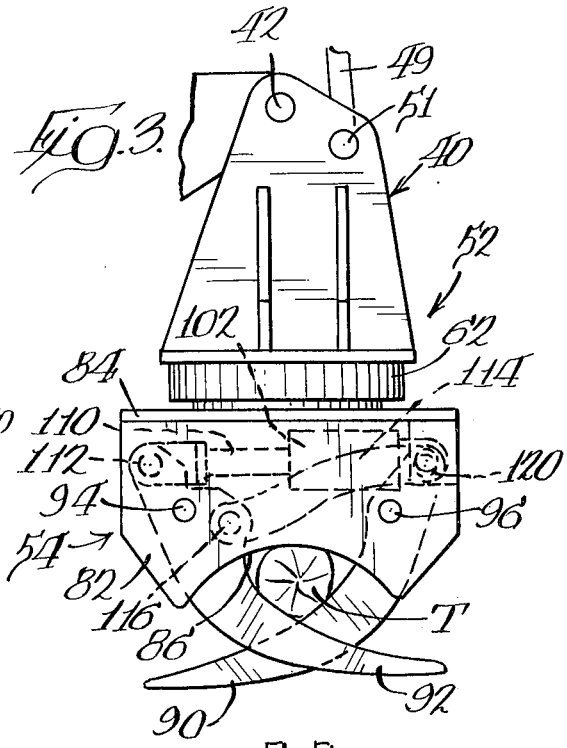
FIG. 3 is a fragmentary view similar to FIG. 2 showing the grapple assembly with a tree length log supported therein.
Figure 4:
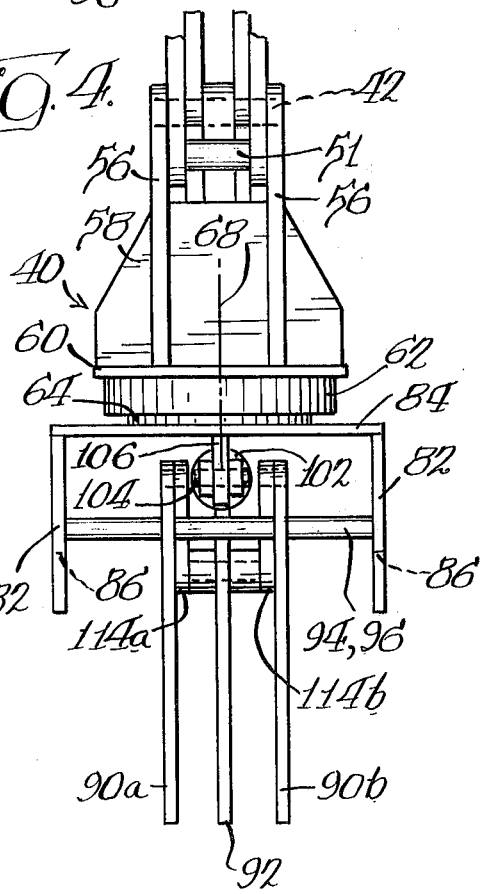
FIG. 4 is an end view, as viewed generally along lines 4—4 of FIG. 2.

According to the present invention, the grab arm assembly or heel boom grapple apparatus 40 consists of an upper frame or head 52 and a lower frame or head 54 (FIGS. 2, 3 and 4). Upper frame 52 includes a pair of spaced plates 56 (FIG. 4) that are pivotally supported on pin 42 on opposite sides of boom section 30. Plates 56 are rigidly interconnected through cross plates 58 with a circular plate 60 secured to the lower ends of plates 56 and 58. Circular plate 60 supports the outer race 62 of a bearing assembly that also includes an inner race 64 (FIG. 2) connected to lower frame 54 with a plurality of ball bearings 66 interposed between the outer and inner bearing races. The lower frame 54 is rotatably supported about a fixed vertical axis 68 defined on upper frame 52 by a shaft 70 and the rotational movement is produced by drive means 72. Drive means 72 consists of a motor 74 having a gear 76 on an output shaft and in mesh with a gear 78 defined on a hub portion 80 of lower frame 54. Thus, actuation of motor 74 will rotate lower frame 54 about vertical axis 68 through 360° of rotation.

According to the present invention, lower frame 54 supports grapple arms and grapple heels in a manner that a tree can be picked up and manipulated through the use of a single fluid ram. More specifically, as illustrated in FIGS. 3 and 4, lower frame 54 incorporates a pair of grapple heels consisting of fixed plates 82 that extend from a generally horizontal plate 84 supporting inner race 64 as well as hub 80. The respective plates, defining grapple heels 82, are located a substantially equal distance from the center line or axis 68 and on opposite sides thereof. As illustrated in FIGS. 2 and 3, the lower edges of plates 82 have an arcuate tree engaging surface 86 defined thereon.

Lower frame or head 54 also supports first and second grapple arms 90 and 92 that are respectively pivoted about pivot pins or rods 94 and 96 defined on lower frame 54. In the illustrated embodiment, pivot axes 94 and 96 are transversely spaced on opposite side of the center line 68 by an equal distance and arms 90 and 92 are capable of being moved between the opened and closed positions respectively shown in FIGS. 2 and 3 by power means that will now be described.

According to one aspect of the present invention, the power means includes a single fluid ram 100 consisting of a cylinder or first element 102 having its head end connected by a pin 104 to plate 84 by a depending lug 106. Fluid ram 100 also has a piston rod or second element 110 that is pivotally connected by pin 112 to one end of one of the arms, such as arm 92. The drive means for the first and second grapple arms 90 and 92 also includes a single rigid synchronizing link 114 that has one end connected by pivot pin 116 to the second grapple arm 92 and its opposite end connected through a second pivot pin 120 to the first grapple arm 90. The pivot pins 116 and 120 for the respective ends of synchronizing link 114 are spaced from the respective pivots 94 and 96 for the respective grapple arms and the geometric relationship between arms 90 and 92 and synchronizing link 114 is such that the second arm 92 is moved an amount equal to the pivotal movement of first arm 90 in response to extension and retraction of the fluid ram 100.

The above arrangement has the unique advantage of being able to collect and support tree length logs on grab arm assembly through the manipulation of a single fluid ram that is located on the grab arm assembly. This arrangement considerably decreases the overall cost of the grab arm assembly attachment as well as the cost for the hydraulic circuitry that must extend from turntable 20 through boom 24 to grab arm assembly 40.

The operation of the present invention is believed to be understood from the above description but will be briefly summarized at this point.

If the vehicle 10 is to be utilized for stacking tree length logs on a truck bed, as illustrated at 140 in FIG. 1, the operator positions the vehicle generally as shown in FIG. 1 in close proximity to a stack of logs on the ground. The operator then manipulates boom 24 and lower frame 54 to a position where arcuate surfaces 86 on boom grapple heels 82 are in longitudinal alignment with the axis of the tree length log adjacent the butt end thereof. The operator then further manipulates the boom 24 to position the tree or trees to be picked up in engagement with the arcuate surfaces 86. Fluid ram 100 is then extended to move grapple arms 90 and 92 from the position illustrated in FIG. 2 to that illustrated in FIG. 3 wherein one or more trees T are grasped between the grapple arms 90 and 92. During this movement, the peripheral surfaces of the tree or trees T are forced into engagement with arcuate surfaces 86 on the spaced grapple heels 82 while the inner peripheral surfaces of grapple arms securely grasp the tree or trees. The boom can then be manipulated so that the length of the tree is in alignment with the elongated dimension of the truck 140 and the tree or trees can be dropped into the truck bed. Since most of the weight of the tree length log is located adjacent the base or butt end, the tree is normally grasped at a location so that the butt end is free to swing past the adjacent boom 24 which allows the operator to manipulate the trees to a position where a certain number of the butt ends are located adjacent the forward end of truck bed 140 while a remaining portion of the butt ends are located adjacent the rear end of truck body 140. This allows the operator to maximize the number of trees that can be placed on a truck bed 140 since approximately one-half of the trees can be positioned to have their butt ends adjacent the forward end of the truck body while the remainder of the trees have their butt ends located adjacent the rear end of the truck body so that the finished load will have an approximate equal height on both ends of the truck body.

While not specifically limited to any type of linkage, FIG. 4 specifically illustrates one type of linkage arrangement that can be utilized for arms 90 and 92. As illustrated in FIG. 4, male arm 92 consists of a single arm that is located between a pair of arms 90*a* and 90*b* located on opposite sides of arm 92. In addition, synchronizing link 114 consists of first and second identical links 114*a* and 114*b* respectively located adjacent opposite surfaces of second arm 92 and between the adjacent arms 90*a* and 90*b*.

While a single fluid ram has been illustrated as being advantageous in the operation of first arm 90, it is readily apparent that two separate, smaller fluid rams could respectively cooperate with the respective arm portions 90*a* and 90*b* which would allow the manufacturer to substantially reduce the size of the fluid rams located on the grab arm assembly. In this version of the invention, both of the fluid rams could be supplied with fluid from a single set of conduits extending through boom 24.

What is claimed is:

1. A heel boom log grappling apparatus comprising an upper frame adapted to be attached to a boom on a vehicle, a lower frame rotatably supported about an axis on said upper frame, drive means between said frames for rotating said frames relative to each other, a pair of grapple heels fixed to said lower frame at spaced locations on opposite sides of said axis, first and second rods extending between said heels and located on opposite sides of said axis, first and second grapple arms respectively pivoted on said first and second rods between said spaced grapple heels, and power means between said lower frame and grapple arms for pivoting said arms so that a log may be gripped between said arms and held in engagement with said grapple heels, said power means including a rigid synchronizing link having opposite ends respectively connected to said arms at locations spaced from the pivotal connections for said arms on said lower frame, and a fluid motor including a cylinder and piston rod with one of said cylinder and piston rod connected to one of said arms and the other of said cylinder and piston rod connected to said lower frame.

* * * * *